US005896149A

United States Patent [19]

Kitahara et al.

[11] Patent Number: 5,896,149

[45] Date of Patent: Apr. 20, 1999

[54] INK JET TYPE RECORDING HEAD HAVING A FLOW PASSAGE SUBSTRATE WITH A STEPPED CONFIGURATION AND RECESSES FORMED IN A SURFACE THEREOF

[75] Inventors: Tsuyoshi Kitahara; Hidetaka Sakurai, both of Nagano, Japan

[73] Assignee: Seiko Epson Corporation, Tokyo, Japan

[21] Appl. No.: 08/660,578

[22] Filed: Jun. 11, 1996

[30] Foreign Application Priority Data

Jun. 12, 1995 [JP] Japan ..... 7-144955
May 23, 1996 [JP] Japan ..... 8-151694

[51] Int. Cl.[6] ..... B41J 2/045

[52] U.S. Cl. ..... 347/70; 347/65

[58] Field of Search ..... 347/68–72, 65; 29/25.35

[56] References Cited

U.S. PATENT DOCUMENTS 5,424,769 6/1995 Sakai et al. ..... 347/70
5,539,982 7/1996 Hosono et al. ..... 347/70 X

FOREIGN PATENT DOCUMENTS

554912 A2 8/1993 European Pat. Off. ..... 347/71
0573055 12/1993 European Pat. Off. .
0 600 382 A2 6/1994 European Pat. Off. ..... B41J 2/16
0600382 6/1994 European Pat. Off. .
0616891 9/1994 European Pat. Off. .
60-139457 7/1985 Japan ..... 347/47
5104711 4/1993 Japan ..... 347/71
5169651 7/1993 Japan ..... 347/71
5-229114 9/1993 Japan ..... B41J 2/045

OTHER PUBLICATIONS

Patent Abstracts of Japan, Publication No. 62135378, dated Jun. 18, 1987.
Patent Abstracts of Japan, Publication No. 59179357, dated Oct. 11, 1984.

*Primary Examiner*—Benjamin R. Fuller
*Assistant Examiner*—C. Dickens
*Attorney, Agent, or Firm*—Sughrue, Mion, Zinn, Macpeak & Seas, PLLC

[57] ABSTRACT

In an ink jet type recording head, a flow passage forming substrate includes pressure generating chambers which are communicated with nozzle openings respectively, a common ink chamber for supplying ink to the pressure generating chambers; and ink supply inlets through which the pressure generating chambers are communicated with the common ink chamber. Each of the ink supply inlets is so designed that it has a narrow part, and it is gradually larger from the narrow part towards the pressure generating chamber, whereby the ink supply inlet is increased in length without changing the flow resistance, and the bonding area near the ink supply inlet is increased.

14 Claims, 7 Drawing Sheets

INK JET TYPE RECORDING HEAD HAVING A FLOW PASSAGE SUBSTRATE WITH A STEPPED CONFIGURATION AND RECESSES FORMED IN A SURFACE THEREOF

BACKGROUND OF THE INVENTION

1. Field of the Invention

This invention relates to an ink jet type recording head of an on-demand system which jets ink droplets in response to printing signals to form dots on a recording medium.

2. Description of the Prior Art

An ink jet type recording head comprises a flow passage unit and a displacement effecting unit. The flow passage unit comprises: a nozzle plate having nozzle openings; a flow passage forming substrate having pressure generating chambers which are communicated with the nozzle openings, a common ink chamber and ink supply inlets; and a vibrating member which sealingly covers the flow passage forming substrate, and which inflates and deflates the pressure generating chambers, being externally displaced. The displacement effecting unit is adapted to apply mechanical energy to the pressure generating chambers through the vibrating member to jet ink.

In the ink jet type recording head, each of the ink supply inlets greatly affect the picture quality of the resultant print as well as each of the nozzle openings, and is an important element which changes the flow passage impedance ratio of the ink supply inlet and the nozzle opening, and the absolute value of the flow passage impedance. Hence, the dimensions and the flow resistances of the ink supply inlet and the nozzle opening greatly affect various characteristics of the recording head such as an ink-droplet jetting speed, a quantity of ink droplet, and an ink-droplet jetting frequency.

This problem may be solved by a technique which has been disclosed, for instance, by Japanese Patent Application No. Hei. 5-229114. That is, by anisotropic-etching a silicon monocrystal wafer, the pressure generating chambers, the common ink chamber, and the ink supply inlets of the flow passage substrate can be formed with high dimensional accuracy.

On the other hand, in a recording head for high-density printing, the pressure generating chambers are large in aspect ratio, and walls 45 (FIG. 7) separating the pressure generating chambers from one another are thin, so that the bonding areas for bonding the nozzle plate and the vibrating member to the flow passage forming substrate are extremely small.

In an example of the conventional recording head described above, as shown in FIG. 7, a bonding region 41 on the side of the nozzle openings 40 is large, 800 μm×141 μm, while bonding regions around ink supply inlets 43, which are formed on one side of the flow passage forming substrate which is opposite to the other side where the pressure generating chambers 42 are formed, are each small, 25 μm×200 μm. The sum of those small bonding regions 44 around the ink supply inlets is also extremely small, about one-twentieth (1/20) of the bonding region 41 provided near the nozzle openings 40, and therefore it is difficult to obtain a sufficient adhesive strength on the side of the ink supply inlets.

Accordingly, at the junctions of the flow passage forming substrate, the nozzle plate and the vibrating member which form the ink flow paths, those components may be separated from one another for instance because of the non-uniform application of the adhesive agent; and the ink may leak from one of the pressure generating chambers into another. Thus, the conventional recording head is low in reliability.

SUMMARY OF THE INVENTION

In view of the foregoing, an object of the invention is to provide an ink jet type recording head in which, while the ink supply inlets are controlled in flow resistance, the nozzle plate, the flow passage forming substrate, and the vibrating member are bonded together with a sufficiently high adhesive strength.

There is provided an ink jet type recording head comprising: a nozzle plate which has a nozzle opening for jetting ink droplets; a flow passage forming substrate laminated on the nozzle plate and having a pressure generating chamber which is communicated with the nozzle opening, a common ink chamber for supplying ink to the pressure generating chamber and an ink supply inlet through which the ink chamber are communicated with the pressure generating chamber; a vibrating member laminated on the flow passage forming substrate; and a displacement effecting section for inflating and deflating the pressure generating chamber through the vibrating member; wherein the ink supply inlet in the flow passage forming substrate has a plurality of steps so that the ink supply inlet gradually expands towards the pressure generating chamber.

With the recording head, bonding regions are obtained between the common ink chamber and the pressure generating chamber which are large in opening area, which provide a sufficiently high adhesive force which resists against a shearing stress produced by the displacement effecting means.

DETAILED DESCRIPTION OF THE PREFERRED EMBODIMENTS

Preferred embodiments of the invention will be described with reference to the accompanying drawings.

Figure 1:
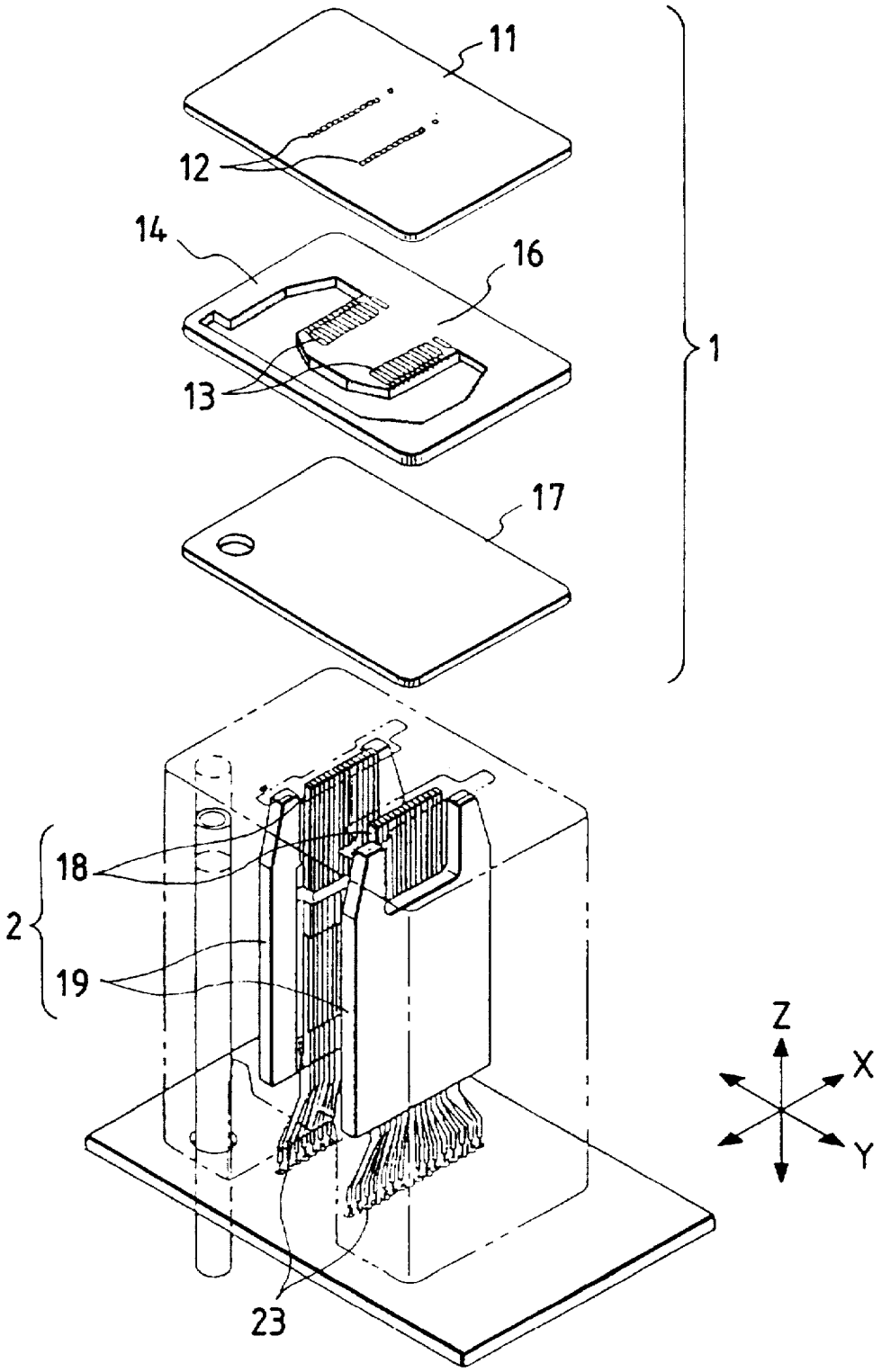
FIG. 1 is an exploded perspective view showing an ink jet type recording head.
Figure 2:
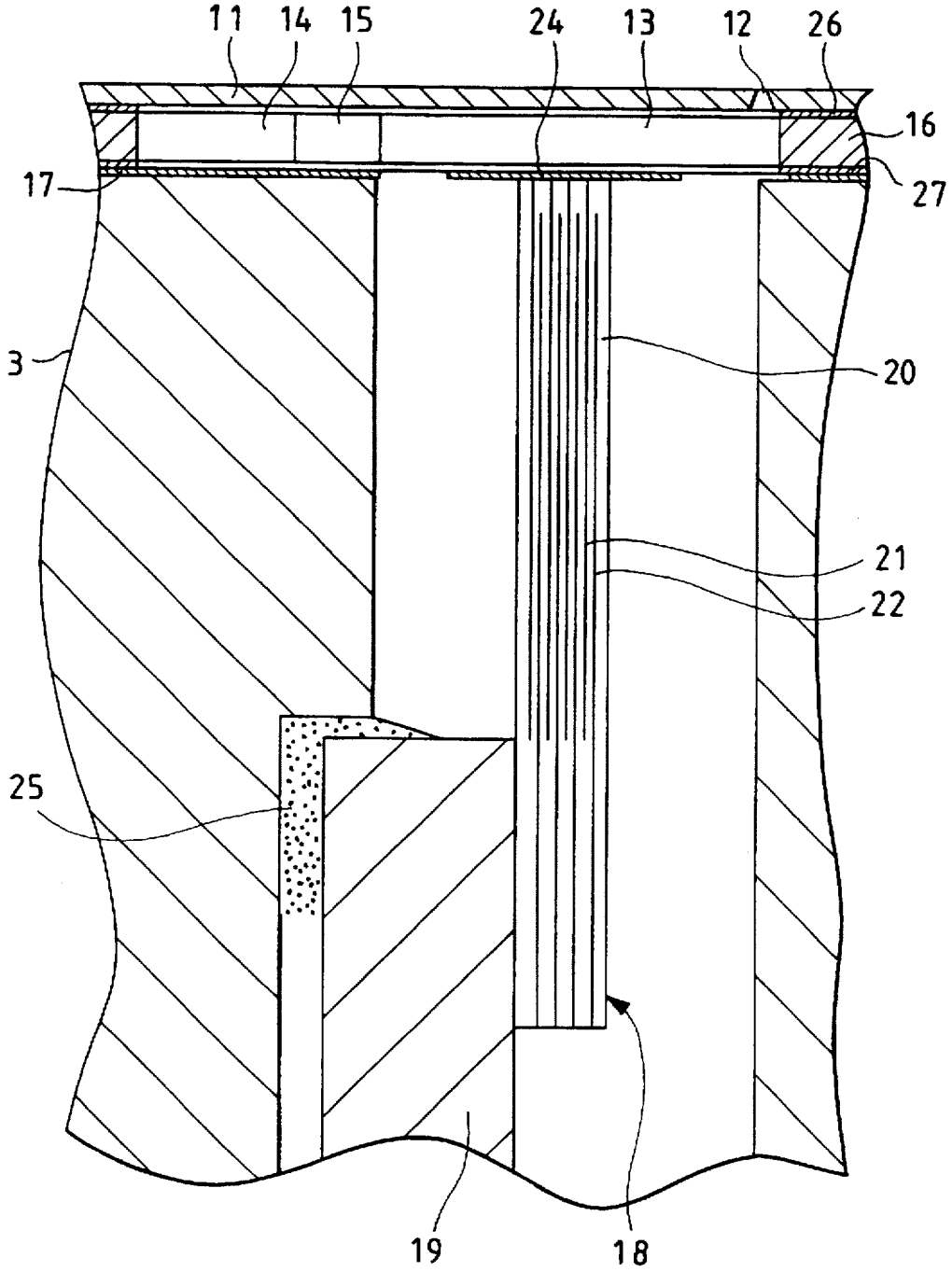
FIG. 2 is a sectional view of part of a recording head according to a first embodiment of the present invention.

FIG. 1 is a perspective view showing the structure of an ink jet type recording head. FIG. 2 is a longitudinal sectional view showing the structure of a pressure generating chamber in the recording head according to a first embodiment of the present invention. Fundamentally, the ink jet type recording head comprises two units, namely, a flow passage unit 1 and a displacement effecting unit 2. The flow passage unit comprises three elements; more specifically, it comprises: a nozzle plate 11; an ink flow passage forming substrate having pressure generating chambers 13, a common ink chamber 14, and ink supply inlets 15; and a vibrating member 17 which is made of a re:sin film, a SUS plate or the like.

The flow passage forming substrate 16 has arrays of pressure generating chambers 13 which are arranged at equal intervals in correspondence to nozzle openings 12, 12, 12 . . . of the nozzle plate 11. The pressure generating chambers 13 are communicated through the respective ink supply inlets 15 to the common ink chamber 14.

The nozzle plate 11, the flow passage forming substrate 16, and the vibrating member 17 are combined together, thus providing the flow passage unit 1. More specifically, the nozzle plate 11 is bonded liquid-tight to one side of the flow passage forming substrate 16 through an adhesive layer 26, while the vibrating member 17 is bonded liquid-tight to the other side of the flow passage forming substrate 16 through an adhesive layer 27.

On the other hand, the displacement effecting unit 2 is designed as follows. The unit 2 includes arrays of displacement effecting sections 18 which are adapted to inflate and deflate the pressure generating chambers 13 to jet ink droplets. The displacement effecting sections 18 are arranged in arrays in the same direction as the pressure generating chambers 13 (in the direction of the arrow X in FIG. 1), and cantilevered to a base stand 19 in such a manner that their ends abut against island-like protrusions 24 which are elastically deformed for inflating and deflating the pressure generating chambers 13.

The displacement effecting sections 18 are each designed as follows. Its free end portion is an active section which comprises a piezo-electric layer 20 in which electrode layers 21 and 22 are alternately arranged. The electrodes 21 are drive electrodes provided respectively for the displacement effecting sections, and the electrodes 22 are parallel-connected to one another as common electrodes. Those electrodes 21 and 22 are connected through lead frames 23 to an external drive circuit (not shown).

The above-described flow passage unit 1 and displacement effecting unit 2 are secured to a head frame 3 with an adhesive agent 25 in such a manner that the ends of the displacement effecting sections 18 abut on the island-like protrusions 24 formed on the vibrating member 17 in the regions which are confronted with the pressure generating chambers 13.

During printing, the displacement effecting sections 18 inflate and deflate the pressure generating chambers 13 to jet ink droplets from the nozzle openings 12, and therefore a considerably great reaction force acts on the displacement generating unit 2. Hence, in order to bond the base stand 19 supporting the displacement effecting sections 18 to the head frame 3, the adhesive agent 25 must be great in the force of adhesion and must resist fatigue. The adhesive agent of this type is low in cure rate at room temperature, thus lowering the work efficiency in the recording head assembling operation. In order to overcome this difficulty, the adhesive agent is heated to a degree of about 60° C. to increase the cure rate.

On the other hand, for convenience in manufacture, the head frame 3 is formed by injection molding macromolecular material, and the displacement effecting sections 18 are formed by using ceramics such as PZT (piezoelectric electrostriction element) showing piezoelectric characteristics.

Figure 3:
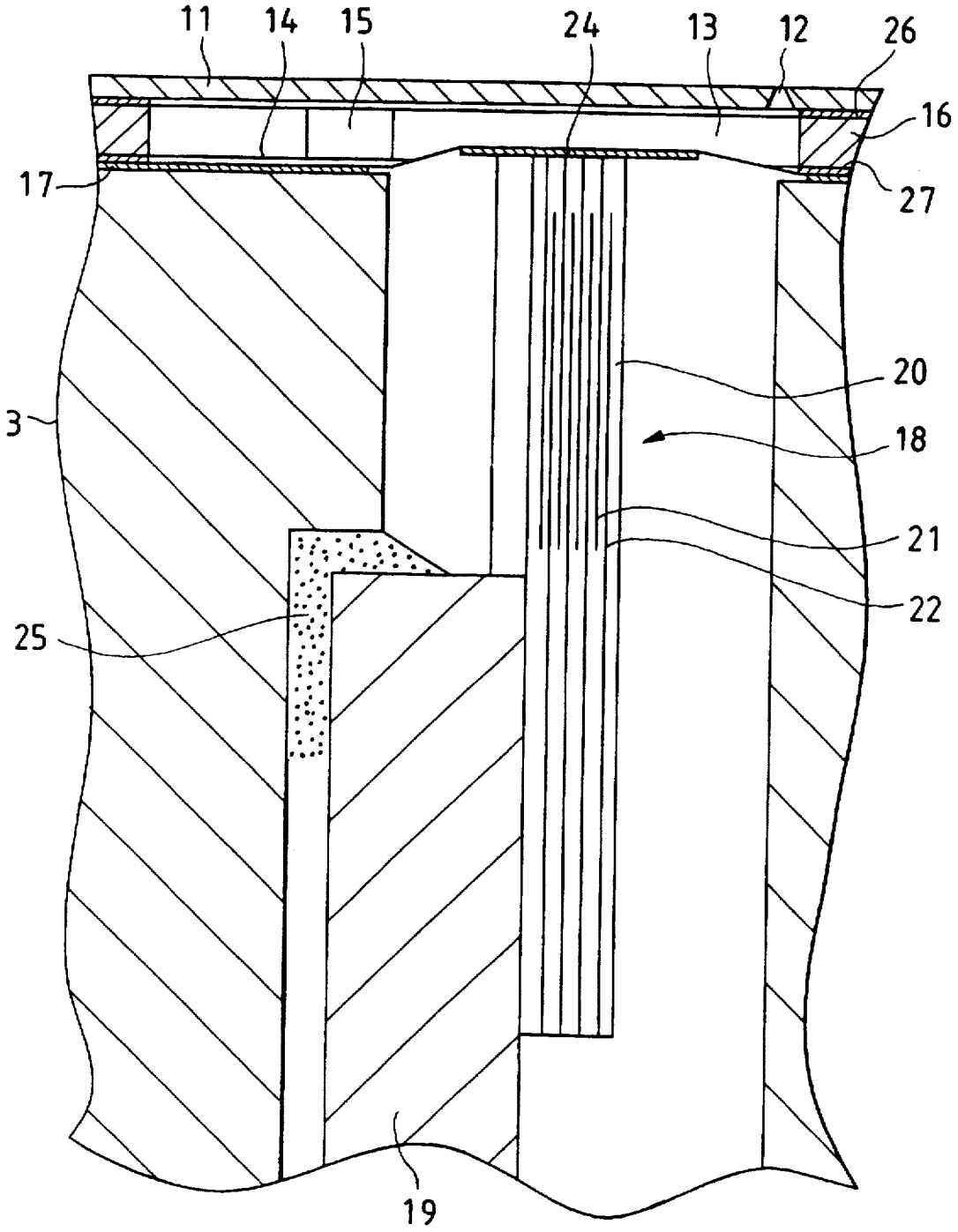
FIG. 3 is a sectional view showing a state of the recording head at room temperature which has been heated so as to join a head frame and a displacement effecting unit together.

As described above, the head frame 3 and the displacement effecting sections 18 are formed by using different materials, namely, macromolecular material and ceramics. Hence, at room temperature, the head frame 3 and the displacement effecting sections 18 are different in length because the room temperature is different from the temperature provided when the base stand 19 is bonded to the head frame, and these elements 3 and 18 are different in thermal expansion coefficient. This difference in length acts as a pressing force collectively near the pressure generating chambers 13 which abut on the ends of the displacement effecting sections 18. As a result, The flow passage forming substrate 16, the vibrating member 17, and the nozzle plate 11 are pushed upwardly, or deformed, as shown in FIG. 3. Because of this deformation, a load is applied to the flow passage forming substrate 16, the vibrating member 17, and the nozzle plate 11 to act, as a shearing force, on the adhesive agent layers 26 and 27 through which those components 16, 17 and 11 are combined together.

Figure 4:
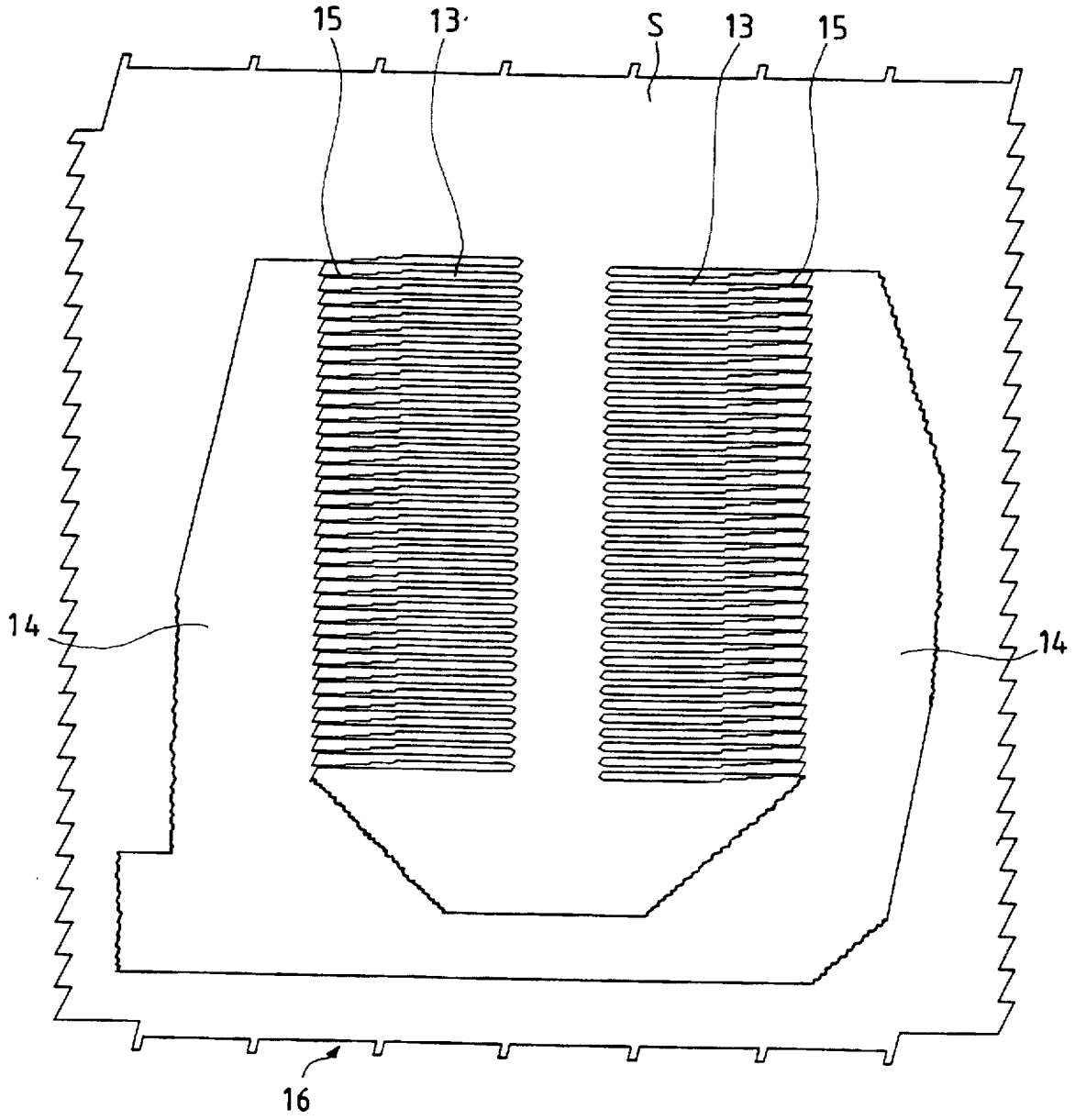
FIG. 4 is a front view showing the first embodiment of a flow passage forming substrate which is formed by cutting a silicon monocrystal wafer.

FIG. 4 shows an embodiment of the flow passage forming substrate 16 which overcomes the above-described difficulty. In FIG. 4, reference character S designates a silicon monocrystal wafer 200 to 300 μm in thickness which has a (110) crystal face. In the wafer S, a plurality of pressure generating chambers 13, and a common ink chamber 14 are formed, and furthermore ink supply inlets are formed as through-holes. The wafer S thus processed is cut out to the size of the aimed ink jet type recording head.

Figure 5:
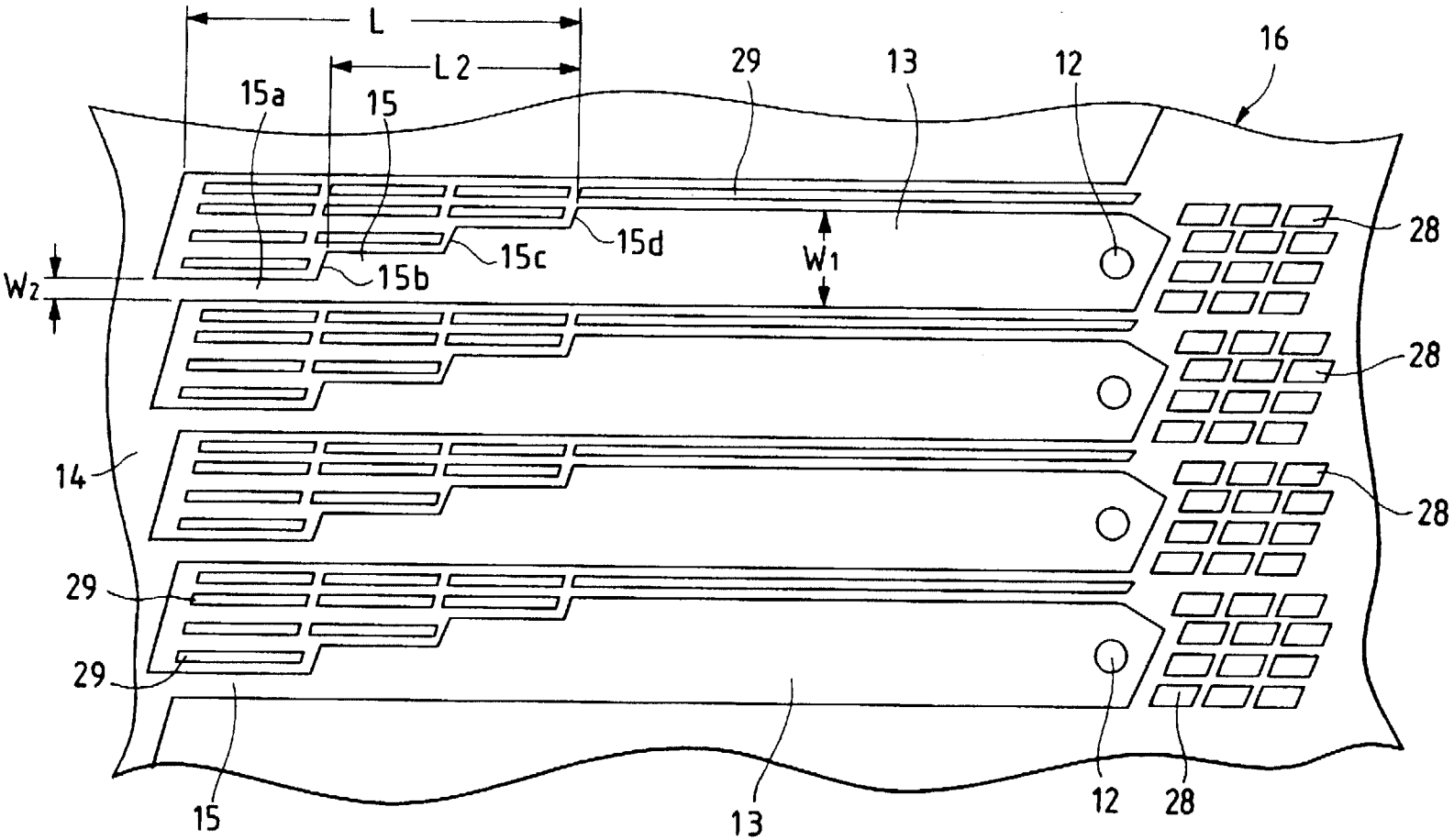
FIG. 5 is an enlarged diagram of the flow passage forming substrate, mainly showing pressure generating chambers and parts concerning the latter.

FIG. 5 shows the ink supply inlets 15 and the pressure generating chambers 13 of the flow passage forming substrate 16, and their relevant parts. In the recording head, the flow resistance of each of the ink supply inlets 15 should be substantially equal that of each of the nozzle openings 12 and much higher than that of each of the pressure generating chambers 13. Hence, each of the ink supply inlets 15 is much smaller in sectional area than each of the pressure generating chamber 13.

That is, in a concrete embodiment of the flow passage forming substrate, the width w1 of the pressure generating chamber 13 is of the order of 100 μm, and the width w2 of the narrowest part 15*a* of the ink supply inlet 15, which substantially determines the flow resistance of the ink supply inlet 15, is of the order of 25 μm.

In addition, the common ink chamber 14 is shifted outwardly, and the distance L for each of the ink supply inlets 15 and the respective pressure generating chamber 13 is increased when compared with that in the conventional flow passage forming substrate. That is, in the embodiment, the distance is of the order of 600 μm which is three times that in the conventional flow passage forming substrate. The width of the ink supply inlet 15 is increased stepwise from the narrowest part 15*a* towards the pressure generating chamber 13. In the example, the ink supply inlet 15 includes three steps 15*b*, 15*c* and 15*d* being larger towards the pressure generating chamber, that is, the width of the ink supply inlet 15 is increased to 100 μm which is substantially equal to the width of the pressure generating chamber 13.

In FIG. 5, reference numerals 28 and 29 designate small recesses or grooves formed in the adhesion regions. Those recesses or grooves absorb an excess of adhesive agent which is going to flow over the substrate during the substrate bonding operation; that is, they serve as adhesive agent absorbing means for preventing the adhesive agent from flowing into the pressure generating chamber and the ink supplying inlets.

Figure 7:
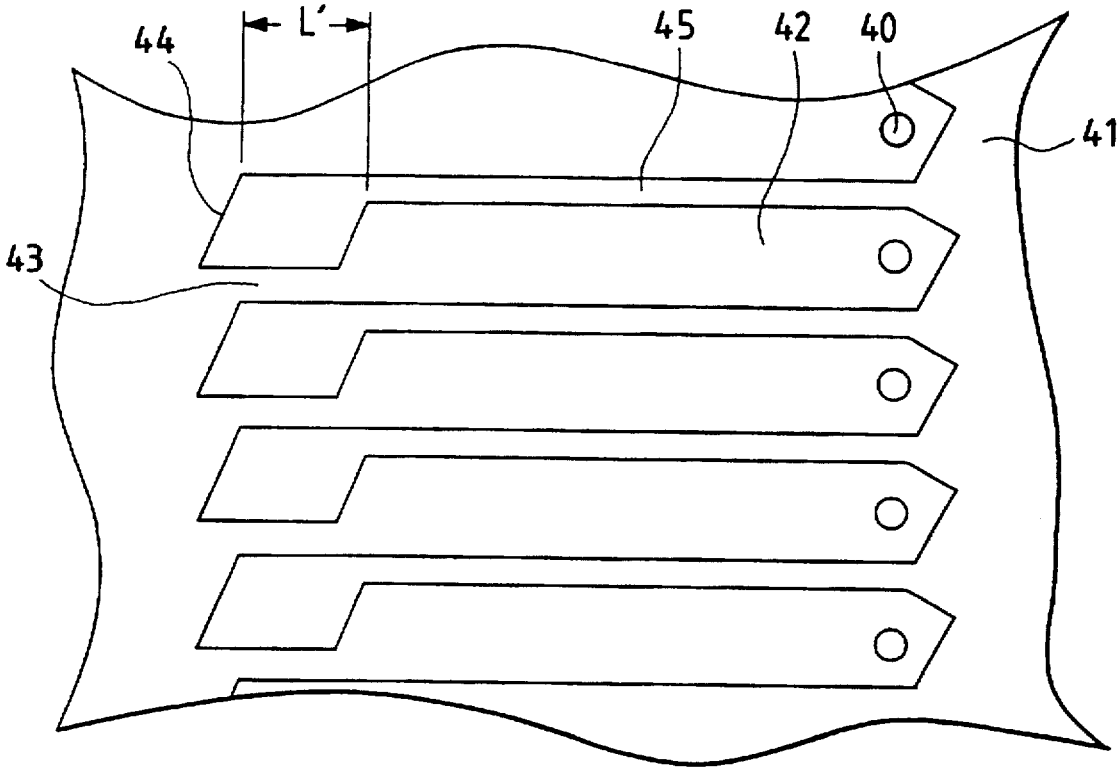
FIG. 7 PRIOR ART
FIG. 7 is an enlarged front view of an example of a flow passage forming substrate in a conventional ink jet type recording head, mainly showing pressure generating chambers and parts concerning the latter.

Thus, between the common ink chamber 14 which, in the flow passage forming substrate 16, is largest in opening area and the pressure generating chambers 13 which are ranked next to the common ink chamber 14 in opening area, a bonding region having some width, 600 μm, is obtained without adversely affecting the function of the ink supply inlets 15. In the recording head of the invention, the length of the ink supply inlet region is larger as much as L2 than that L' (FIG. 7) of the conventional ink supply inlet, and therefore the bonding region is about twice as large as that in the conventional recording head.

In order to confirm the effects of the above described increase in bonding region, the temperature of the recording head was changed from a heating temperature of 60° C. used for hardening the adhesive agent to a temperature of −30° C. to which it may be cooled for instance during transportation by airplane, and the adhesive agent layers 26 and 27 of the flow passage forming board, the nozzle plate, and the vibrating member were inspected. However, none of the layers 26 and 27 were peeled off them.

The width of each of the ink supply outlets 15 are gradual y larger from the ink chamber 14 towards the pressure generating chamber 13. That is, the width change between the ink supply outlets 15 and the pressure generating chamber 13 is relaxed as compared with that of the conventional recording head. Hence, in the case where, in order to regain the ink jetting performance, the ink is forcibly discharged by the application of a negative pressure to the nozzle openings 12, the formation of eddies in the boundary between the ink supply inlet and the pressure generating chamber is sufficiently suppressed, so that bubbles near the boundary can be also readily discharged from the nozzle opening 12.

Figure 6A:
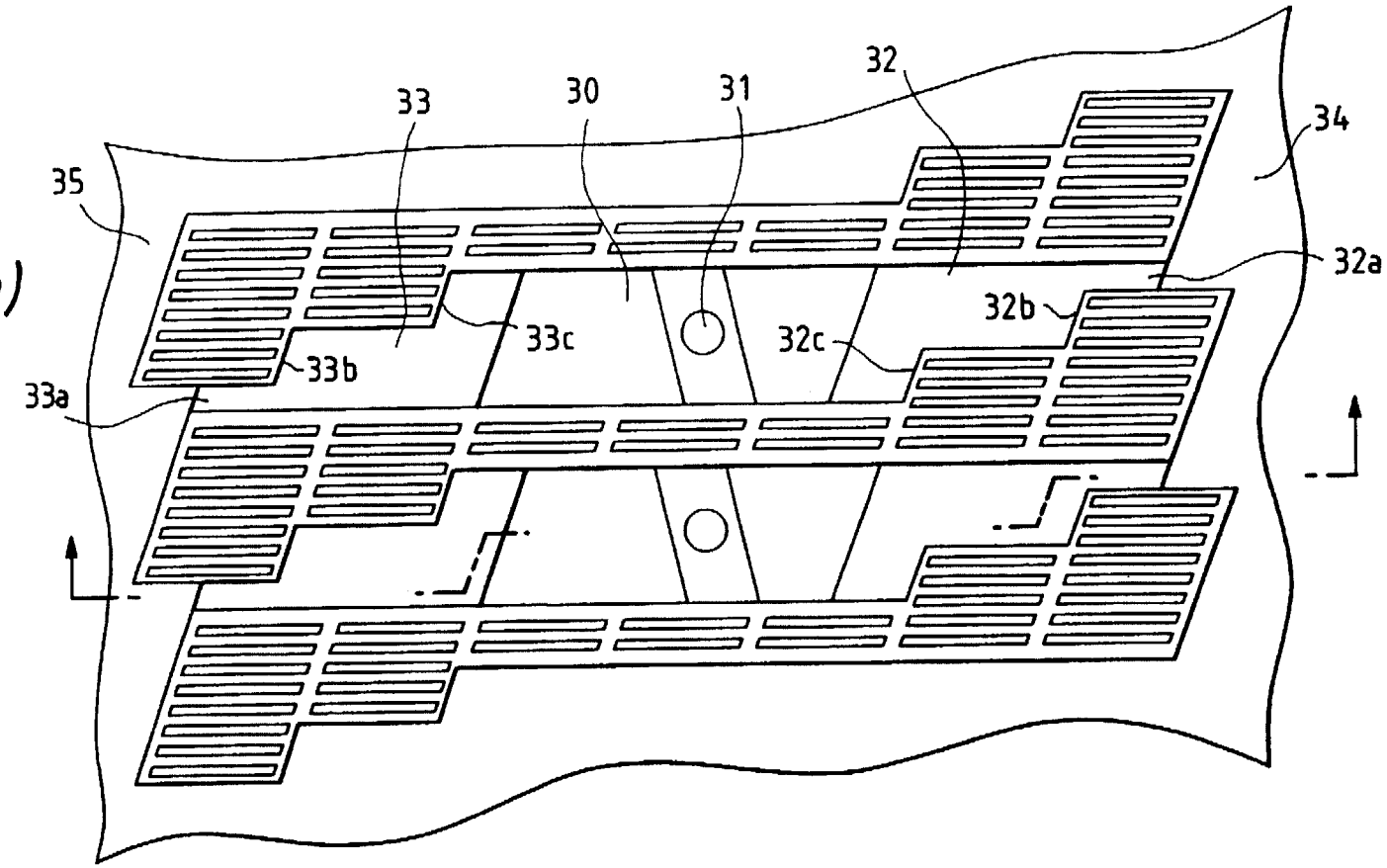
FIG. 6(*a*) is an enlarged diagram of a second embodiment of the flow passage forming substrate, mainly showing pressure generating chambers and parts concerning the latter, and FIG. 6(*b*) is a sectional diagram taken along line A—A in FIG. 6(*a*)
Figure 6B:
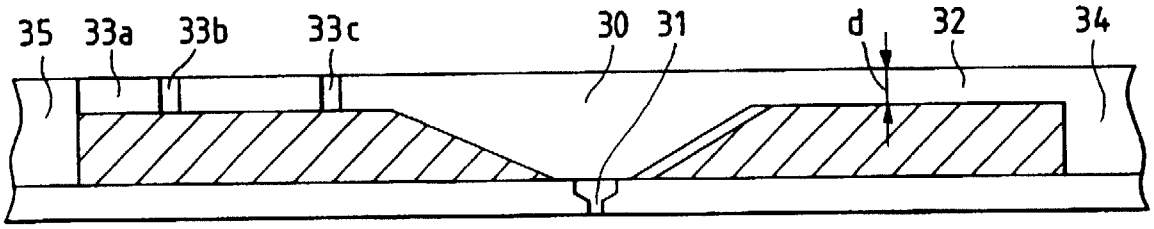

The above described embodiment is the recording head of the type that one end portion of each of the pressure generating chambers is communicated with the respective nozzle opening, and the ink is supplied from one side of the pressure generating chamber. However, the invention is not limited thereto or thereby. That is, the recording head may be modified as shown in FIGS. 6(*a*) and 6(*b*). This is a second embodiment of the invention. In the second embodiment, a nozzle opening 31 is located at the center of each of the pressure generating chambers 30; and ink supply inlets 32 and 33, and common ink chambers 34 and 35 are provided on both sides of the pressure generating chambers 30, so that the recording head is improved in ink supplying performance; that is, it is operated at high speed. Thus, the second embodiment is more noticeable in effect than the first embodiment.

More specifically, in the case where the two common ink chambers 34 and 35 are arranged on both sides of the pressure generating chambers 30, the bonding regions around the pressure generating chambers 30 are very small. However, in the second embodiment, this problem is solved as follows. In each of the ink supply inlets, the narrowest parts 32*a* and 33*a* are provided on the sides of the common ink chambers, and are communicated through long passageways including a plurality of steps 32*b*, 32*c*, 33*b* and 33*c* with the pressure generating chamber 30. Hence, in the second embodiment, while the ink supply inlets 32 and 33 are maintained most suitable in flow resistance for the ink jetting operation, the bonding region can be increased, that is, the adhesive strength can be increased. In addition, both ends of the pressure generating chambers receive equally the load applied thereto. This feature eliminates the difficulty that the adhesive agent layers peel off the flow passage forming unit at a particular point or points.

In the case where the ink supply inlets 32 and 33 are formed on both sides of the pressure generating chambers 30, the flow resistance of each of the ink supply inlets must be higher than in the case where each pressure generating chamber has only one ink supply inlet. However, if the narrowest parts are decreased in width to increase the flow resistance, then it is difficult to make the dimensions of the ink supply inlets high in accuracy. Therefore, in this case, it is preferable that the depth d of the ink supply inlets is made smaller by half-etching.

As described above, an ink jet type recording head according to the present invention comprises: a nozzle plate which has a nozzle opening for jetting ink droplets; a flow passage forming substrate laminated on the nozzle plate and having a pressure generating chamber which is communicated with the nozzle opening, a common ink chamber for supplying ink to the pressure generating chamber and an ink supply inlet through which the ink chamber are communicated with the pressure generating chamber; a vibrating member laminated on the flow passage forming substrate; and a displacement effecting section for inflating and deflating the pressure generating chamber through the vibrating member; wherein the ink supply inlet in the flow passage forming substrate has a plurality of steps so that the ink supply inlet gradually expands towards the pressure generating chamber.

Hence, bonding areas can be obtained between the common ink chamber and the pressure generating chamber which are large in opening area, which provides an adhesive force which resists; against the shearing force produced by the displacement effecting means.

What is claimed is:

1. An ink jet type recording head comprising:

a nozzle plate which has a nozzle opening for jetting ink droplets;

a flow passage forming substrate laminated on said nozzle plate, said flow passage forming substrate having a pressure generating chamber communicating with said nozzle opening, a common ink chamber for supplying ink to said pressure generating chamber and at least one ink supply inlet through which said common ink chamber is communicated with said pressure generating chamber;

a vibrating member laminated on said flow passage forming substrate; and a displacement effecting section operably contacting said vibrating member for inflating and deflating said pressure generating chamber by contact with said vibrating member;

wherein said at least one ink supply inlet in said flow passage forming substrate has a plurality of steps formed on an interior portion of said supply inlet from said common ink chamber to said pressure generating chamber to gradually expand a width dimension of said ink supply inlet from said common ink chamber towards said pressure generating chamber.

2. The ink jet type recording head according to claim 1, wherein said pressure generating chamber has a first and a second end, said first end of said pressure generating chamber communicating with said nozzle opening and said second end of said pressure generating chamber is communicated through said ink supply inlet to said common ink chamber.

3. The ink jet type recording head according to claim 1, wherein said flow passage forming substrate includes a second common ink chamber and a second ink supply inlet, wherein said pressure generating chamber is communicated with said nozzle opening at a center portion of said pressure generating chamber, and a first and a second end of said pressure generating chamber are communicated with a respective one of said first and second common ink chambers through a respective one of said first and second ink supply inlets.

4. The ink jet type recording head according to claim 3, wherein a depth of said first and second ink supply inlets is less than a thickness of said flow passage substrate.

5. The ink jet type recording head according to claim 4, wherein said depth of said first and second ink supply inlets is less than a depth of said pressure generating chamber and less than a depth of said first and second common ink chambers.

6. The ink jet type recording head according to claim 1, wherein said flow passage forming substrate is made from a silicon monocrystal wafer and wherein said pressure generating chamber, said common ink chamber and said ink supply inlet are formed by anisotropic-etching said silicon monocrystal wafer.

7. The ink jet type recording head according to claim 1, wherein said nozzle plate, said flow passage forming substrate, said vibrating member are bonded by adhesive, and recesses for absorbing excess of said adhesive are formed in adhesion regions of said flow passage forming substrate.

8. The ink jet type recording head according to claim 1, wherein said vibrating member has an elastic deformation portion which is elastically deformed for inflating and deflating said pressure generating chamber, and an end of said displacement effecting section abuts against said elastic deformation portion.

9. The ink jet type recording head according to claim 1, wherein said flow passage forming substrate further comprises a plurality of indentations formed in at least an upper surface of said flow passage forming substrate, said plurality of indentations disposed in a step-wise configuration corresponding to the plurality of steps of said ink supply inlet.

10. The ink jet type recording head according to claim 9, wherein a length of said at least one ink supply inlet is approximately 600 μm.

11. The ink jet type recording head according to claim 9, wherein a width of said ink supply inlet is approximately 25 μm at a first end of said ink supply inlet and gradually expands to approximately 100 μm at a second end of said ink supply inlet.

12. The ink jet type recording head according to claim 1, wherein the width of said ink supply inlet consistently increases in gradual increments from said common ink chamber to said pressure generating chamber.

13. An ink jet type recording head comprising:

means for pressurizing ink to jet ink droplets from a nozzle opening;

means for supplying the ink to the pressurizing means; and means for guiding the ink from the supplying means to the pressurizing means;

wherein the guiding means gradually expands from the supplying means towards the pressurizing means, wherein the guiding means includes a plurality of steps that gradually expands a width of the guiding means from the supplying means to the pressurizing means.

14. The ink jet type recording head according to claim 13, wherein the width of said guiding means consistently increases in gradual increments from the supplying means to the pressurizing means.

* * * * *